US011555272B2

(12) United States Patent
Imai

(10) Patent No.: US 11,555,272 B2
(45) Date of Patent: Jan. 17, 2023

(54) PRINT PROCESSING APPARATUS, HEATING DEVICE, AND PRINT PROCESSING METHOD

(71) Applicant: Hiroyuki Imai, Kanagawa (JP)

(72) Inventor: Hiroyuki Imai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 17/338,387

(22) Filed: Jun. 3, 2021

(65) Prior Publication Data

US 2021/0388560 A1 Dec. 16, 2021

(30) Foreign Application Priority Data

Jun. 15, 2020 (JP) ..... JP2020-103136

(51) Int. Cl.
*D06P 5/30* (2006.01)
*D06P 5/20* (2006.01)
*B41J 3/407* (2006.01)

(52) U.S. Cl.
CPC ..... *D06P 5/2083* (2013.01); *B41J 3/4078* (2013.01); *D06P 5/2077* (2013.01); *D06P 5/30* (2013.01)

(58) Field of Classification Search
CPC ..... D06P 5/2083; D06P 5/2077; D06P 5/30; B41J 3/4078
USPC ..... 8/444, 445
See application file for complete search history.

(56) References Cited

U.S. PATENT DOCUMENTS 5,847,729 A * 12/1998 Takahashi ..... B41J 11/0024 346/139 A
2017/0205742 A1* 7/2017 Shoji ..... G03G 15/2039
2018/0345691 A1* 12/2018 Ku ..... B41J 2/01
2019/0289161 A1* 9/2019 Yoshigai ..... B41M 7/009
2019/0303734 A1* 10/2019 Tamaki ..... G06K 15/005
2020/0032452 A1* 1/2020 Kemma ..... B41J 11/00244

FOREIGN PATENT DOCUMENTS

EP 0659577 B1 * 6/1995 ..... B41K 1/32
JP 2010-058426 3/2010
JP 2019-073829 5/2019
JP 2019-155765 9/2019
JP 2020-015292 1/2020
WO WO 2005/106109 A1 * 11/2005 ..... B41M 5/0358

* cited by examiner

*Primary Examiner* — Eisa B Elhilo
(74) *Attorney, Agent, or Firm* — Duft & Bornsen, PC

(57) ABSTRACT

A print processing apparatus, a heating device, and a method of performing a printing process. The print processing apparatus includes a heating device including a heater, the heater performing at least one of contactless heating to heat a fabric in a state where the heater is not in contact with the fabric and contact heating to heat the fabric in a state where the heater is in contact with the fabric, and a memory to store a condition table retaining a condition in which whether the contactless heating is to be performed, whether the contact heating is to be performed, an order in which the contactless heating and the contact heating are performed, and a temperature and a length of time in at least one of the contactless heating and the contact heating to be performed are determined for each kind of the fabric.

8 Claims, 7 Drawing Sheets

FIG. 4

116a

| MATERIAL | DETAIL | TEMPERATURE OF CONTACT-LESS HEATING (°C) | LENGTH OF TIME OF CONTACTLESS HEATING (SECOND) | TEMPERATURE OF CONTACT HEATING (°C) | LENGTH OF TIME OF CONTACT HEATING (SECOND) | ORDER |
|---|---|---|---|---|---|---|
| MATERIAL 0001 | MANUFACTURER: AAA SERIAL NUMBER: XXXX | 200 | 100 | 200 | 100 | CONTACTLESS HEATING → CONTACT HEATING |
| MATERIAL 0002 | MANUFACTURER: AAA SERIAL NUMBER: XXXX | 220 | 120 | 200 | 60 | CONTACT HEATING → CONTACTLESS HEATING |
| MATERIAL 0003 | MANUFACTURER: BBB SERIAL NUMBER: XXXX | 180 | 150 | 150 | 180 | CONTACTLESS HEATING → CONTACT HEATING |
| MATERIAL 0004 | MANUFACTURER: BBB SERIAL NUMBER: XXXX | 200 | 180 | – | 0 | – |
| ⋮ | ⋮ | ⋮ | ⋮ | ⋮ | ⋮ | ⋮ |

PRINT PROCESSING APPARATUS, HEATING DEVICE, AND PRINT PROCESSING METHOD

CROSS-REFERENCE TO RELATED APPLICATION

This patent application is based on and claims priority pursuant to 35 U.S.C. § 119(a) to Japanese Patent Application No. 2020-103136, filed on Jun. 15, 2020, in the Japan Patent Office, the entire disclosure of which is hereby incorporated by reference herein.

BACKGROUND

Technical Field

Embodiments of the present disclosure relate to a print processing apparatus, a heating device, and a print processing method.

Background Art

Currently, print processing apparatuses that can perform printing processes on a fabric such as a garment are known in the art. In such print processing apparatuses, for example, heating processes are performed such that ink will be fixed onto the fabric. In order to achieve such fixation of ink onto the fabric, for example, technologies to perform two-step heating are known in the art. In the first step, a heater or the like does not contact the fabric onto which the ink is jetted and the fabric are heated indirectly. Subsequently, in the second step, the heater or the like contacts the fabric and the fabrics are heated directly. Due to such a configuration, the durability of ink fixation improves, and the length of time of heating operation can be shorted.

SUMMARY

Embodiments of the present disclosure described herein provide a print processing apparatus, a heating device, and a method of performing a printing process. The print processing apparatus includes a heating device including a heater, the heater performing at least one of contactless heating to heat a fabric in a state where the heater is not in contact with the fabric and contact heating to heat the fabric in a state where the heater is in contact with the fabric, a memory to store a condition table retaining a condition in which whether the contactless heating is to be performed, whether the contact heating is to be performed, an order in which the contactless heating and the contact heating are performed, and a temperature and a length of time in at least one of the contactless heating and the contact heating to be performed are determined for each kind of the fabric, an input and output unit through which the condition is selected from the condition table based on a kind of the fabric on which printing is to be performed, and a controller to control elements of the print processing apparatus, the elements of the print processing apparatus including the heating device, the memory, and the input and output device. In the print processing apparatus, the controllers to cause the heating device to perform the at least one of the contactless heating and the contact heating specified in the selected condition on the with the temperature, the length of time, and the order in which the contactless heating and the contact heating are performed, which are specified in the selected condition. The heating device includes the heater to heat a fabric on which an image is formed by jetted ink, a lift to lift or lower the fabric to a contactless heating position where contactless heating is performed to heat the fabric in a state where the heater is not in contact with the fabric and to a contact heating position where contact heating is performed to heat the fabric in a state where the heater is in contact with the fabric, the memory, and the controller. The method includes selecting a condition based on a kind of the fabric on which printing is to be performed from the condition table, and performing at least one of the contactless heating and the contact heating specified in the selected condition on the fabric with the jetted ink, with a temperature, a length of time, and an order in which the contactless heating and the contact heating are performed, which are specified in the selected conditions.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

FIG. 4 is a diagram illustrating the data structure of a garment catalogue retained in a garment printer according to an embodiment of the present disclosure.

Figure 1:
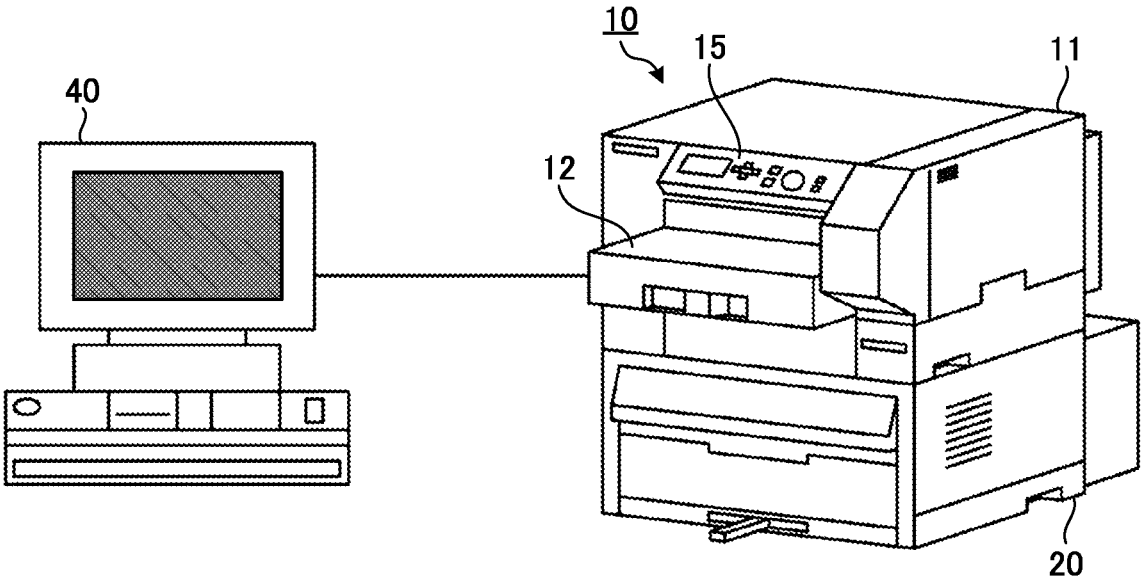
FIG. 1 is a diagram illustrating a configuration of a print processing system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more central processing units (CPUs), digital signal processors (DSPs), application-specific integrated circuits (ASICs), field-programmable gate arrays (FPGAs), computers or the like. These terms may be collectively referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note that numerous additional modifications and variations are possible in light of the above teachings. It is therefore to be understood that within the scope of the appended claims, the disclosure of the present disclosure may be practiced otherwise than as specifically described herein. For example, elements and/or features of different illustrative embodiments may be combined with each other and/or substituted for each other within the scope of this disclosure and appended claims.

EMBODIMENTS

Some embodiments of the present disclosure are described below with reference to the drawings.

FIG. 1 is a diagram illustrating a configuration of a print processing system 1 according to an embodiment of the present disclosure.

As illustrated in FIG. 1, the print processing system 1 according to the present embodiment includes a garment printer 10 and a host personal computer (PC) 40 connected to the garment printer 10.

The garment printer 10 and the host PC 40 may be connected to each other in a direct manner through a wired or wireless connection. Alternatively, the garment printer 10 and the host PC 40 may be connected to each other through a network such as a wide area network (WAN) including, for example, the local area network (LAN) and the Internet.

The garment printer 10 that serves as a print processing apparatus can perform printing processes on, for example, a fabric such as a garment. The garment printer 10 includes a print engine 11, a cassette 12, an operation panel 15, and a heating device 20. The print engine 11 as an image forming device according to the present embodiment is provided with a write head, a recording head, or the like, and forms an image on a fabric. When an image is to be formed on the fabric, a fabric is placed on the top face of the cassette 12, and that cassette is inserted into the print engine 11. Then, the print engine 11 controls the write head or the recording head such that ink will be jetted onto the fabric, in accordance with the printing instructions input through the operation panel 15 or the instructions sent from the host PC 40. As a result, an image is formed on the fabric such as a garment.

The heating device 20 according to the present embodiment heats the fabric on which an image is formed by the jetted ink such that the ink will be fixed onto the fabric, in accordance with the heating instructions input through the operation panel 15 or the instructions sent from the host PC 40. The fabric on which an image has been formed is placed on the top face of the cassette 12, and the cassette 12 is accommodated inside the heating device 20 when the fabric is heated.

The heating device 20 adjusts the temperature of a heater provided for the heating device to a predetermined temperature, and adjusts the distance between the heater and the accommodated cassette 12. Due to such configurations as described above, the fabric may be heated indirectly without touching the heater provided for the heating device, or the fabric may contact the heater and be heated directly.

In the contact heating where the heater provided for the heating device 20 contacts the fabric, the ink can be dried quickly, and the ink can be fixed to the fabric quickly. However, if the fabric is pressed against the heater before the ink is dried, there are some cases in which the ink in a liquid state sticks to the heater, there is a possibility that the heating device 20 is contaminated or damaged.

In the contactless heating where the fabric does not touch the heater provided for the heating device 20, even before the ink is dried, the ink can be prevented from sticking to the heater. However, as the fabric is separated from the heater when heating is performed, it could take a long time before the ink is fixed onto the fabric.

In order to handle such a situation, as will be described later in detail, the garment printer 10 according to the present embodiment is configured such that the switching between the contactless heating and the contact heating is enabled depending on the type or kind of the fabric.

The operation panel 15 accepts various kinds of input such as printing instructions and the heating instructions. Moreover, in the present embodiment, the operation panel 15 displays various kinds of information such as the results of the printing operation performed by the garment printer 10 and the status of the garment printer 10, e.g., the status of the print engine 11 and the heating device 20.

The host PC 40 that serves as a host computer exchanges various kinds of data with the garment printer 10. For example, the host PC 40 sends various types of instructions such as the printing instructions and heating instructions input through the host PC 40 to the garment printer 10. Moreover, in the present embodiment, the host PC 40 receives, for example, the results of the printing operation performed by the garment printer 10.

As described above, various kinds of instructions for the garment printer 10 may be input from the host PC 40 instead of, for example, the instructions input through the operation panel 15. Moreover, in the present embodiment, the various kinds of information that are displayed on the operation panel 15 may be viewed through the host PC 40.

Figure 2:
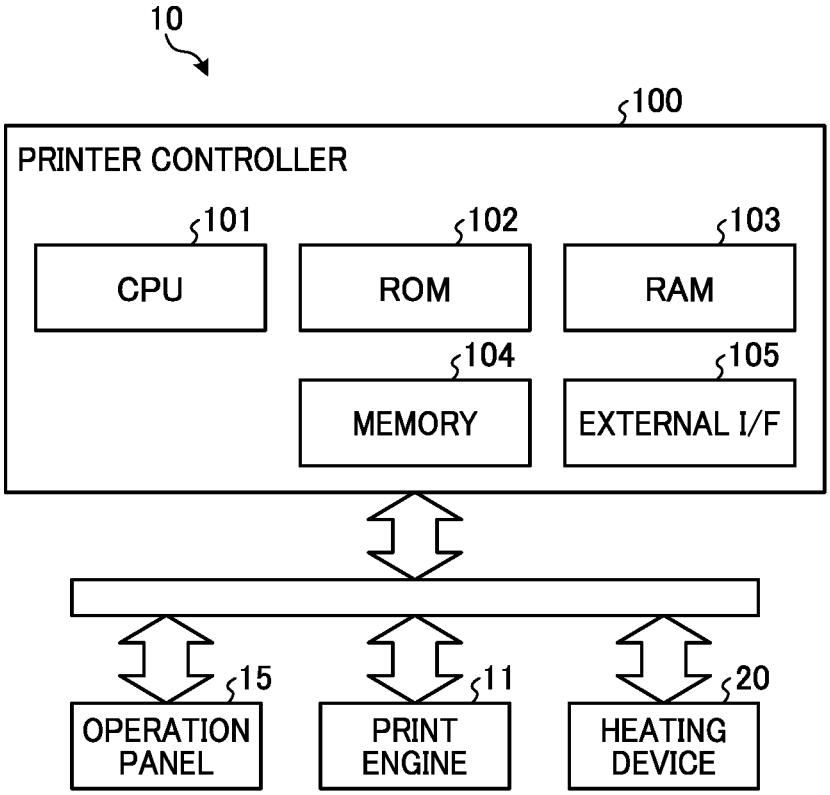
FIG. 2 is a block diagram illustrating a hardware configuration of a garment printer according to an embodiment of the present disclosure.

FIG. 2 is a block diagram illustrating a hardware configuration of the garment printer 10 according to the present embodiment.

As illustrated in FIG. 2, in addition to the configuration or structure as described above, the garment printer 10 according to the present embodiment is provided with a printer controller 100 that controls the elements of the garment printer 10.

The printer controller 100 that serves as a controller is configured as a computer or the like that includes a central processing unit (CPU) 101, a read only memory (ROM) 102, a random access memory (RAM) 103, a memory 104, and an external interface (I/F) 105.

For example, the CPU 101 uses the RAM 103 as a work area, and executes a program stored, for example, in the ROM 102. Due to such a configuration, the CPU 101 controls the inputs and outputs of the various kinds of information displayed on the operation panel 15. Moreover, the CPU 101 performs printing processes including, for example, image-forming processes and heating on the fabric on which printing is to be performed, in accordance with the instructions sent from, for example, the operation panel 15 or the host PC 40.

In the printing processes, the CPU 101 according to the present embodiment causes ink to be jetted out of the print engine 11 to form an image on the fabric. Moreover, the CPU 101 causes the heating device 20 to heat the fabric such that the ink will be fixed onto the fabric. In so doing, the CPU 101 causes the heating device 20 to perform heating based on, for example, selected one of the conditions stored in the memory 104 that are determined for each one of the types or kinds of the fabric.

The memory 104 may be used as an auxiliary memory of, for example, a hard disk drive (HDD) or a solid state drive (SSD). The memory 104 stores a garment catalogue in which the conditions that are determined for each one of the types or kinds of the fabric are written.

An external interface 105 enables the data communication between the garment printer 10 and an external device such as the host PC 40. The data communication between the garment printer 10 and an external device such as the host PC 40 may be performed under the standard of, for example, the Ethernet (registered trademark) and the universal serial bus (USB) (registered trademark).

Figure 3:
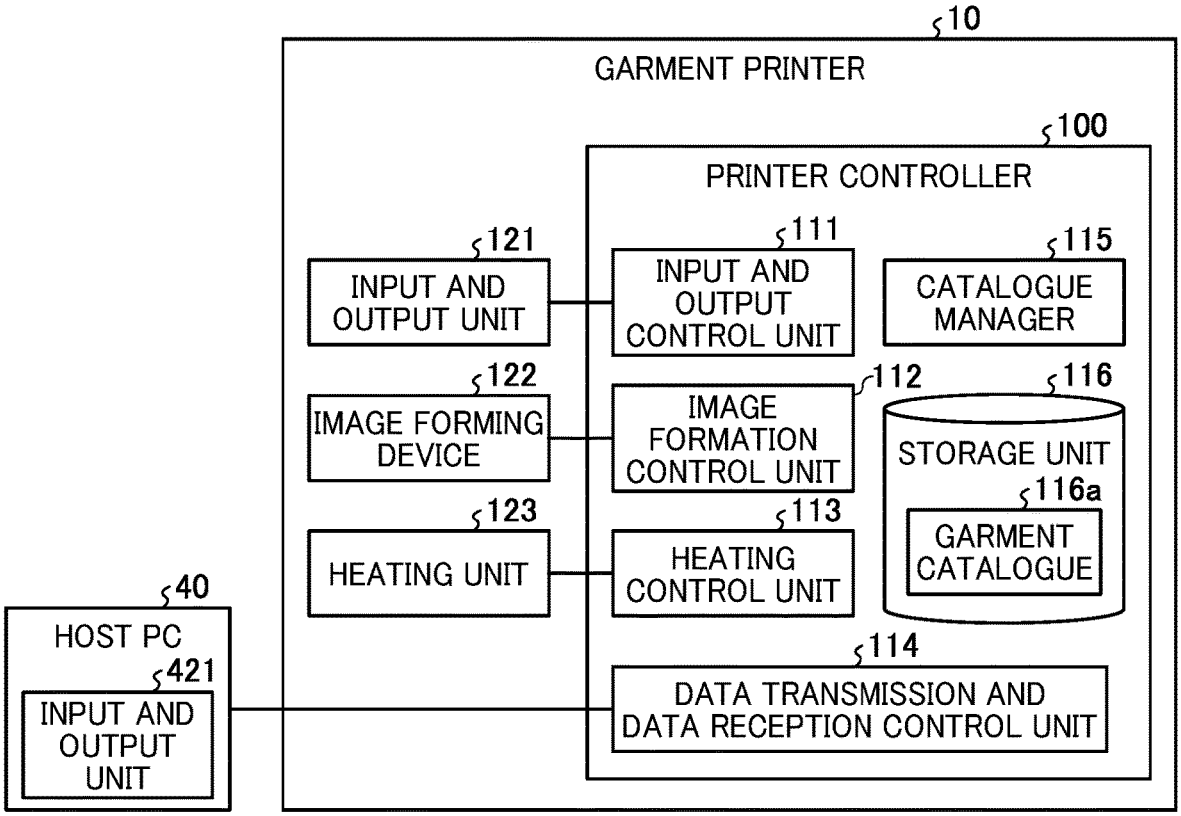
FIG. 3 is a block diagram illustrating a software configuration of a garment printer according to an embodiment of the present disclosure.

FIG. 3 is a block diagram illustrating a software configuration of the garment printer 10 according to the present embodiment.

As illustrated in FIG. 3, as a program is executed by the CPU 101 provided for the printer controller 100 of the garment printer 10, for example, an input and output control unit 111, an image formation control unit 112, a heating control unit 113, and a catalogue manager 115 are implemented by the printer controller 100.

For example, a data transmission and data reception control unit 114 is implemented by the external interface 105 that is under control of the CPU 101 that executes a program. Moreover, for example, a storage unit 116 is implemented by the memory 104 that is under control of the CPU 101 that executes a program.

The input and output control unit 111 serves as a user interface (UI). In other words, the input and output control unit 111 controls an input and output unit 121 to accept various kinds of input through the input and output unit 121. Moreover, the input and output control unit 111 causes the input and output unit 121 to output, for example, the information about the garment printer 10. For example, the input and output unit 121 according to the present embodiment is implemented by the operation panel 15 that is controlled by the CPU 101 that executes a program.

The image formation control unit 112 according to the present embodiment controls an image forming device 122 to perform printing processes on the fabric on which printing is to be performed. For example, the image forming device 122 according to the present embodiment is implemented by the print engine 11 that is controlled by the CPU 101 that executes a program.

The heating control unit 113 according to the present embodiment controls a heating unit 123 to perform heating on the fabric on which an image has been formed. As a result, the ink is fixed onto the fabric. For example, the heating unit 123 according to the present embodiment is implemented by the heating device 20 that is controlled by the CPU 101 that executes a program. When heating is to be performed, the heating control unit 113 obtains the selected condition from the catalogue manager 115, and controls the heating unit 123 in accordance with the selected condition.

The data transmission and data reception control unit 114 according to the present embodiment performs data exchange with the garment printer 10 and an external device such as the host PC 40. When, for example, instructions for the garment printer 10 is sent to the data transmission and data reception control unit 114 from an input and output unit 421 provided for the host PC 40, the data transmission and data reception control unit 114 accepts such input from the input and output unit 421 provided for the host PC 40.

For example, the input and output unit 421 of the host PC 40 is implemented by an output device such as a display placed under control of the CPU of the host PC 40, and an input device such as a keyboard or a mouse. Alternatively, the input and output unit 421 of the host PC 40 may be implemented by, for example, a touch panel with an inputting and outputting function.

The catalogue manager 115 according to the present embodiment manages the garment catalogue **116*a* stored in a storage unit 116. In the garment catalogue 116*a*** that serves as a condition table, for example, the conditions for the heating process that are set for each type of the fabric are retained.

When the fabric is to be heated, for example, the type of to-be-processed fabric is selected. The catalogue manager 115 extracts the conditions for the selected fabric from the garment catalogue **116*a* stored in the storage unit 116, and passes the extracted conditions to the heating control unit 113**. Due to such configurations as described above, optimized conditions can be chosen for the to-be-processed fabric.

The storage unit 116 according to the present embodiment stores the garment catalogue **116*a* in which a plurality of conditions optimized for each type of fabric are set. An example of the garment catalogue 116*a* is described below with reference to FIG. 4**.

FIG. 4 is a diagram illustrating the data structure of the garment catalogue **116*a* retained in the garment printer 10**, according to an embodiment of the present disclosure.

As illustrated in FIG. 4, the garment catalogue **116*a*** retains a plurality of conditions optimized for each type of fabric. Each one of the sets of conditions includes items such as a reference number that indicates the material or the like of the fabric, the manufacturer of the material, the temperature and length of time in contactless heating that are linked to the serial numbers, the temperature and length of time in contact heating that are linked to the serial numbers.

As described above, in the garment printer 10 according to the present embodiment, for example, the temperature and length of time in contactless heating, the temperature and length of time in contact heating, and the order in which the contactless heating and the contact heating are performed are set for each type of the fabric. When either one of the contactless heating and the contact heating is not to be performed, the temperature and the length of time in that heating is left blank as in the conditions depicted in the fourth row of FIG. 4. As described above, whether the contactless heating is to be performed and whether the contact heating is to be performed are also included in each set of conditions. These set values are optimized for each type of fabric in view of, for example, the durability of ink fixation, the efficiency of heating operation, and the prevention of color fading on the fabric. As described above, in the garment printer 10 according to the present embodiment, the heating is controlled depending on the type or kind of the fabric.

The capabilities or functions of the garment printer 10 according to embodiments of the present disclosure are further described below in detail with reference to FIG. 5, FIG. 6, FIG. 7, FIG. 8, FIG. 9A, FIG. 9B, and FIG. 9C.

Figure 5:
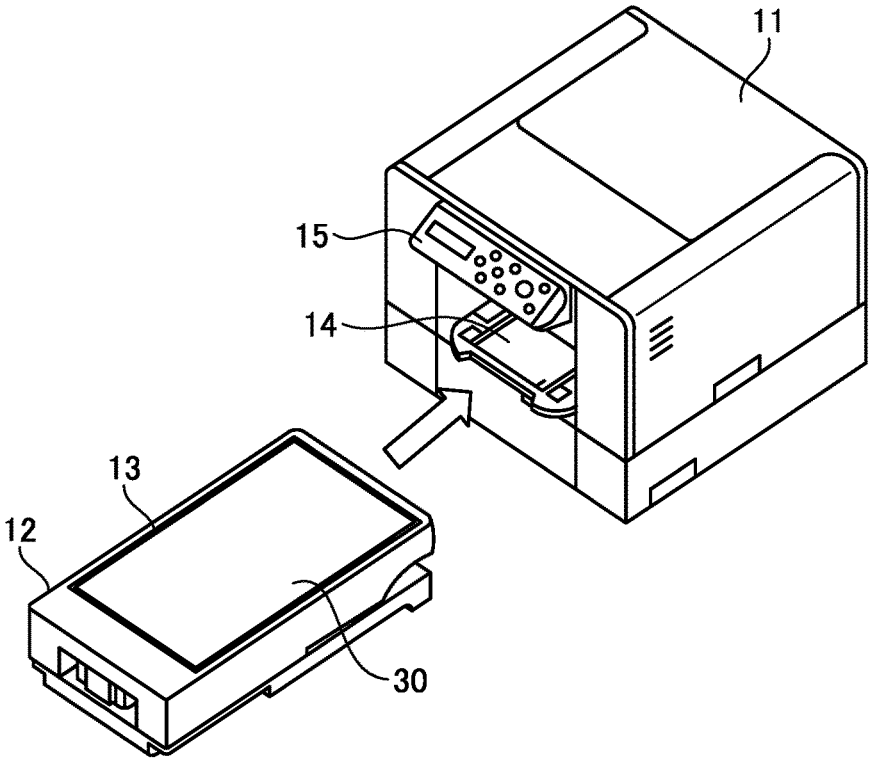
FIG. 5 is a diagram illustrating how a cassette is inserted into a print engine according to an embodiment of the present disclosure.

FIG. 5 is a diagram illustrating how the cassette 12 is inserted into the print engine 11 according to the present embodiment.

As illustrated in FIG. 5, the cassette 12 has a platen 13 on its top face. The fabric 30 on which printing is to be performed is placed on the platen 13 of the cassette 12, and the cassette 12 is placed above a stage 14 of the print engine 11.

For example, printing instructions for the fabric 30 are input through the operation panel 15 or the like of the garment printer 10. In so doing, for example, the image data that is retained in the garment printer 10 can be specified. Such a series of operations may be made through the above host PC 40. In such a configuration, image data may be sent from the host PC 40 to the garment printer 10.

According to the operations as described above, an image is formed as the print engine 11 causes ink to be jetted from the recording head included of the print engine 11 onto the fabric 30 placed on the platen 13.

A series of these processes can also be described in terms of the functional configuration as described above with reference to FIG. 3. For example, it can be described that once printing instructions and image data are input through the input and output unit 121, the input and output control unit 111 of the printer controller 100 accepts the data input through the input and output unit 121.

Accordingly, printing instructions and image data may be input through the input and output unit 421 of the host PC 40. In such a configuration, the data transmission and data reception control unit 114 accepts the data input through the input and output unit 421 of the host PC 40.

The image formation control unit 112 according to the present embodiment controls the image forming device 122 based on the printing instructions and image data accepted through the input and output control unit 111 or the data transmission and data reception control unit 114, and causes ink to be jetted out of the image forming device 122 to form an image on the fabric 30.

Figure 6:
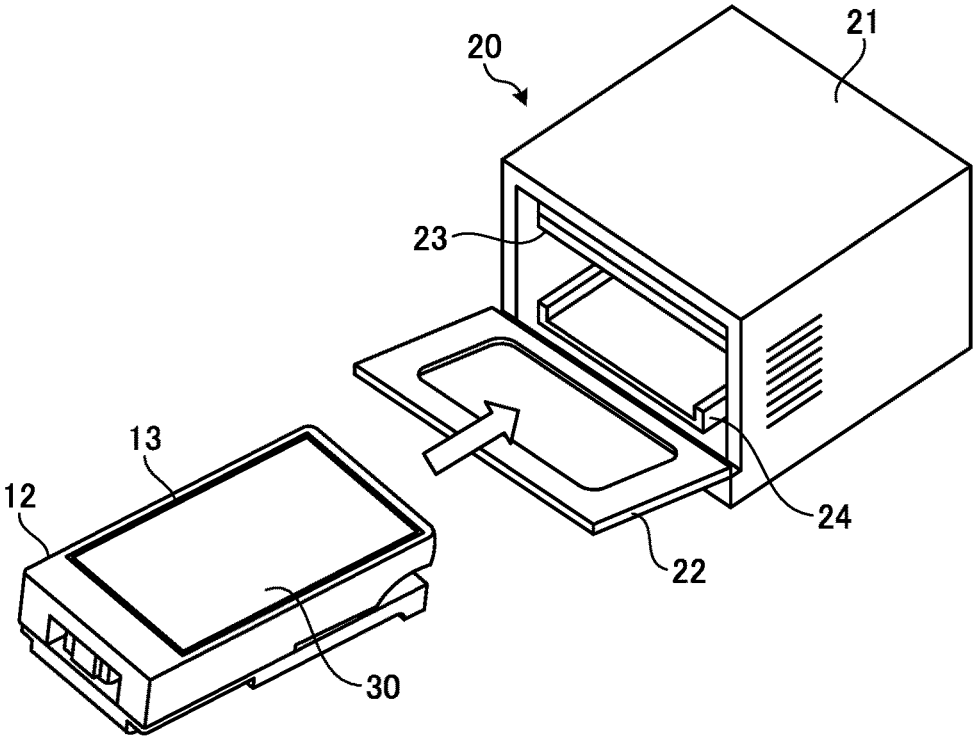
FIG. 6 is a diagram illustrating how a cassette is taken into a heating device according to an embodiment of the present disclosure.

FIG. 6 is a diagram illustrating how the cassette 12 is taken into the heating device 20 according to the present embodiment.

As illustrated in FIG. 6, the heating device 20 according to the present embodiment includes a container 21, a cover 22, a heater 23, and a cassette table 24. As described above, the container 21 accommodates the cassette table 24, and is provided with the cover 22 that hermetically seals the container 21. Accordingly, the cassette 12 can be stored therein. As a lifting and lowering unit that serves as a lift is provided underneath the cassette table 24, the accommodated cassette 12 can be lifted or lowered. Moreover, a heater 23 that can adjust the temperature of an object to a prescribed temperature is arranged in an upper portion of the container 21.

The fabric 30 on which an image has been formed is placed on the platen 13 of the cassette 12, and is stored in the heating device 20. Then, the cover 22 is closed.

For example, heating instructions for the fabric 30 are input through the operation panel 15 or the like of the garment printer 10. In such heating instructions, desired conditions can be chosen from the garment catalogue 116*a* based on the type of fabric of the fabric 30 on which heating is to be performed. How such instructions or selection are made is illustrated in FIG. 7 and FIG. 8.

Figure 7:
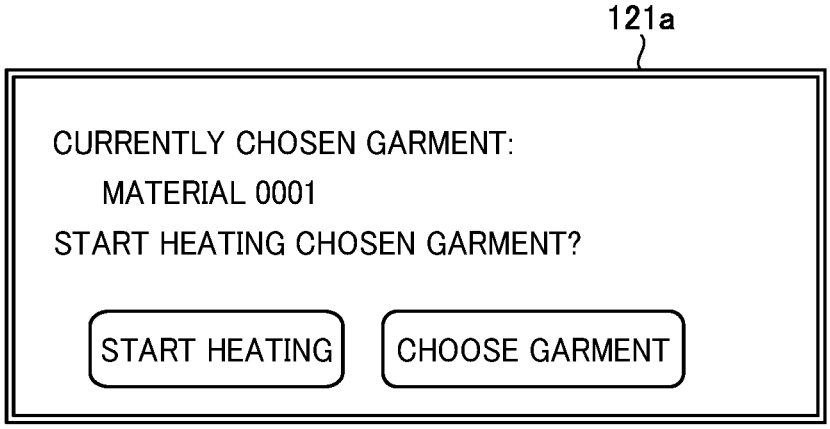
FIG. 7 is a diagram illustrating a heating starting screen displayed on an operation panel of a garment printer according to an embodiment of the present disclosure.
Figure 8:
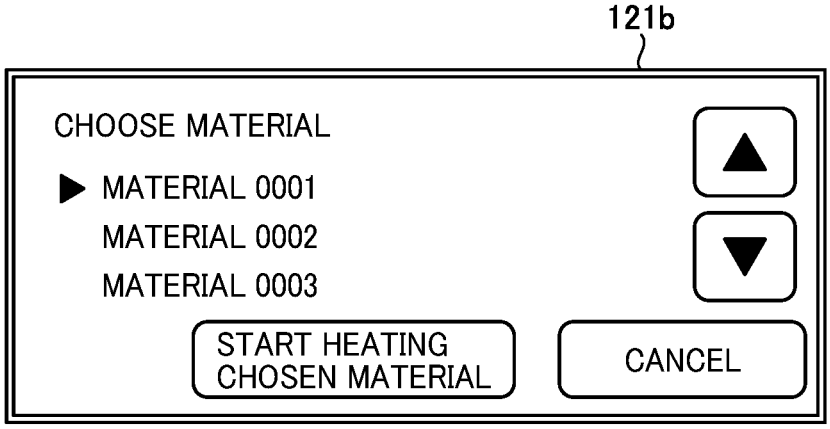
FIG. 8 is a diagram illustrating a selection screen displayed on an operation panel of a garment printer according to an embodiment of the present disclosure.

FIG. 7 is a diagram illustrating a heating starting screen 121*a* displayed on the operation panel 15 of the garment printer 10 according to the present embodiment.

As illustrated in FIG. 7, the heating starting screen 121*a* is displayed on the operation panel 15 in response to the heating instructions, and for example, a reference number that is given to the material is presented to a user based on, for example, the material of the currently selected fabric such as a garment.

If the presented reference number indicates the fabric 30 on which heating is to be performed, a "start heating" key that is displayed on the heating starting screen 121*a* can be touched or clicked to start heating on the fabric 30 stored in the heating device 20.

In the heating device 20 according to the present embodiment, firstly, contactless heating is performed with the set temperature and length of time in accordance with the conditions linked to the currently-selected material, and then in a similar manner to the above contactless heating, contact heating is performed with the set temperature and length of time in accordance with the conditions linked to the currently-selected material.

On the other hand, if the reference number that is presented on the operation panel 15 is different from the fabric 30 on which heating is to be performed, a "choose garment" key that is displayed on the heating starting screen 121*a* is touched or clicked.

FIG. 8 is a diagram illustrating a selection screen 121*b* displayed on the operation panel 15 of the garment printer 10, according to the present embodiment. As illustrated in FIG. 8, the selection screen 121*b* is displayed on the operation panel 15 in response to touching or clicking of the "choose garment" key on the heating starting screen 121*a*, and a list of reference numbers of selectable materials is presented to a user. In other words, a list of selectable materials is a list of materials for which the conditions are set in the above garment catalogue 116*a*.

For example, an "up-and-down" key may be manipulated to choose the reference number of the fabric 30 on which heating is to be performed. After the selection, a "start heating chosen material" key can be touched or clicked to start heating on the fabric 30 stored in the heating device 20. At this stage, a "cancel" key may be touched or clicked to cancel the heating instructions.

In the heating device 20 according to the present embodiment, at least one of the contactless heating and the contact heating is performed with the set temperature, the length of time, and the order in accordance with the conditions linked to the chosen material.

Such a series of operations may be made through the above host PC 40. In such cases, for example, the heating starting screen 121*a* and the selection screen 121*b* are displayed as described above by a printer driver executable by the host PC 40, and such a printer driver may retain the same garment catalogue as the garment catalogue 116*a* retained in the garment printer 10.

In a similar manner to the above, through the host PC 40, the conditions suitable for the fabric 30 can be chosen by selecting the reference number of the material that indicates the fabric 30 on which heating is to be performed. For example, the instructions to start heating and the conditions that are chosen on the host PC 40 are sent to the garment printer 10.

A series of these processes can also be described in terms of the functional configuration as described above with reference to FIG. 3. For example, it can be described that once heating instructions are input through the input and output unit 121, the input and output control unit 111 of the printer controller 100 accepts the data input through the input and output unit 121.

Moreover, the input and output control unit 111 controls the input and output unit 121 to display the heating starting screen 121*a* in accordance with the heating instructions input through the input and output unit 121. When the "choose garment" key is touched or clicked on the heating starting screen 121*a*, the input and output control unit 111 causes the input and output unit 121 to display the selection screen 121*b*.

Moreover, the input and output control unit 111 accepts the chosen reference number of the material when the "start heating" key is touched or clicked on the heating starting screen 121*a* or when the "start heating chosen material" key is touched or clicked on the selection screen 121*b*. When the "cancel" key is touched or clicked on the selection screen 121*b*, the printer controller 100 terminates the processes without executing any further heating.

In such a configuration, heating instructions may be made as the reference number of the material that indicates the fabric 30 on which heating is to be performed is selected through the input and output unit 421 of the host PC 40 to choose the conditions suitable for the fabric 30. In such a configuration, the data transmission and data reception control unit 114 accepts the data input through the input and output unit 421 of the host PC 40.

When the "start heating" key is touched or clicked on the heating starting screen 121*a* and no change is made from the currently-selected material, the conditions that are linked to the currently-selected material are already loaded into the heating control unit 113. The heating control unit 113 causes the heating unit 123 to perform heating on the fabric 30 in accordance with the conditions that are chosen and has already loaded into the heating control unit 113.

When the reference number of one of the materials is chosen on the selection screen 121*b* and the "start heating chosen material" key is touched or clicked, the catalogue manager 115 refers to the garment catalogue 116*a* stored in the storage unit 116, and obtains the conditions that are linked to the chosen material. Moreover, the catalogue manager 115 according to the present embodiment passes the obtained conditions to the heating control unit 113.

The heating control unit 113 according to the present embodiment reads the conditions received from the catalogue manager 115. Accordingly, the chosen conditions are loaded into the heating control unit 113. The heating control unit 113 causes the heating unit 123 to perform heating on the fabric 30 in accordance with the chosen conditions.

Figure 9A:
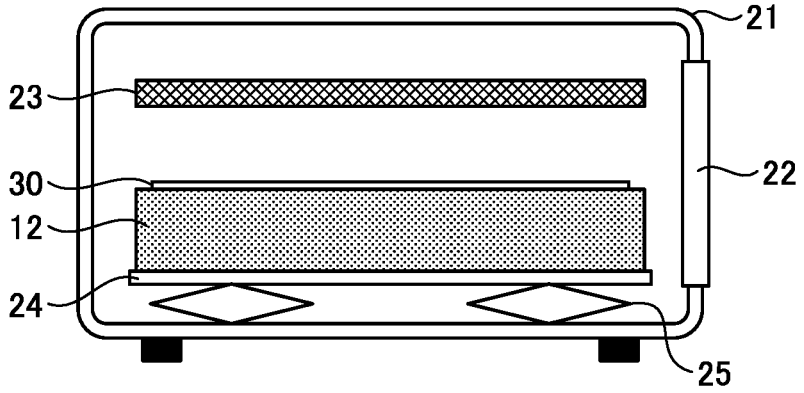
FIG. 9A, FIG. 9B, and FIG. 9C are diagrams each illustrating the operations in a heating device according to an embodiment of the present disclosure.
Figure 9B:
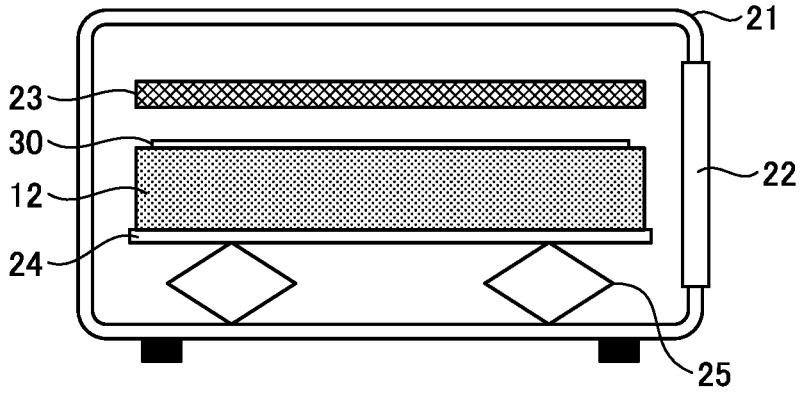
Figure 9C:
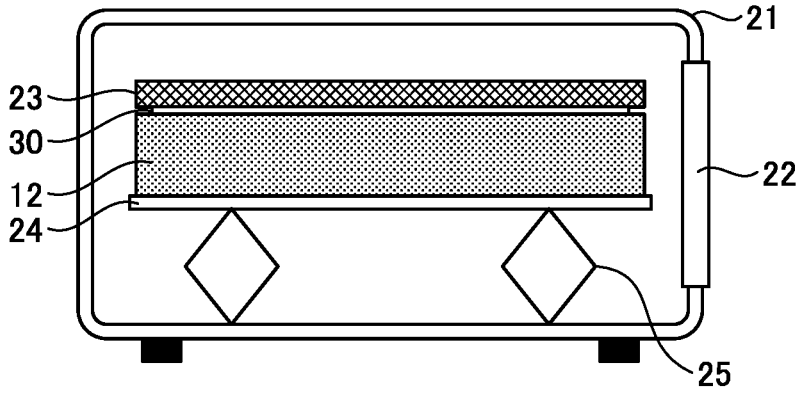

FIG. 9A, FIG. 9B, and FIG. 9C are diagrams each illustrating the operations in the heating device 20 according to the present embodiment.

The operations in the heating device 20 as illustrated in FIG. 9A, FIG. 9B, and FIG. 9C correspond to the operations that are performed by the heating unit 123 in accordance with the control of the heating control unit 113.

FIG. 9A is a diagram illustrating a state in which the cassette 12 stored in the heating device 20 is at a standby position, according to the present embodiment.

As illustrated in FIG. 9A, the material on which an image has been formed is placed on the top face of the cassette 12, and the cassette 12 is placed on the cassette table 24 that is arranged inside the container 21 of the heating device 20.

The lifting and lowering unit 25 is provided underneath the cassette table 24. The lifting and lowering unit 25 is a lift that is a mechanism for lifting and lowering the cassette table 24 and the cassette 12 placed on the cassette table 24. In FIG. 9A, the lifting and lowering unit 25 is lowered to the lowest position. In other words, the cassette 12 is at the height of the standby position farthest from the heater 23.

Once instructions are provided to start heating after the cassette 12 is stored in the heating device 20 in a state as illustrated in FIG. 9A and the conditions suitable for the fabric 30 on which heating is to be performed are chosen, the temperature of the heater 23 is controlled to change to a set temperature of the heating to be performed. Accordingly, the heating will be performed at the temperature specified in the chosen conditions, and the length of time specified in the chosen conditions. Moreover, the heating will be performed in the order in which the contactless heating and the contact heating are performed, which is specified in the chosen conditions. Once the temperature of the heater 23 is adjusted to the set temperature, the lifting and lowering unit 25 is driven, and the cassette 12 is lifted to a position at which either one of the contactless heating and the contact treatment is performed.

FIG. 9B is a diagram illustrating a state in which the cassette 12 stored in the heating device 20 is in a contactless heating position where the contactless heating is performed, according to the present embodiment.

As illustrated in FIG. 9B, in the contactless heating position, the cassette 12 is disposed closer to the heater 23 than the above standby position, and the fabric 30 that is placed on the upper surface of the cassette 12 is disposed at a height where the fabric 30 does not contact the heater 23.

The fabric 30 on the cassette 12 is held at the contactless heating position as illustrated in FIG. 9B for the length of time of the contactless heating according to the chosen conditions. For the above length of time, the heater 23 is maintained at the set temperature of the contactless heating. Due to such a configuration, the fabric 30 is subjected to the contactless heating at an appropriate temperature, and the fabric 30 is subjected to the contactless heating for an appropriate length of time.

Once the set length of time of the contactless heating has passed, the lifting and lowering unit 25 is driven to lift or lower the cassette 12 to a position where the contact heating is performed or the standby position in accordance with the chosen conditions. For example, when the chosen conditions indicate that the contact heating is to be performed next, the temperature of the heater 23 is adjusted to a set temperature in the contact heating and then the cassette 12 is moved to a contact heating position where the contact heating is to be performed.

FIG. 9C is a diagram illustrating a state in which the cassette 12 stored in the heating device 20 is in a contact heating position where the contactless heating is to be performed, according to the present embodiment.

As illustrated in FIG. 9C, in the contact heating position, the cassette 12 is disposed at the height where the fabric 30 that is placed on the upper surface of the cassette 12 contacts the heater 23.

The fabric 30 on the cassette 12 is held at the contact heating position as illustrated in FIG. 9C for the length of time of the contact heating according to the chosen conditions. For the above length of time, the heater 23 is maintained at the set temperature of the contact heating. Due to such a configuration, the fabric 30 is subjected to the contact heating at an appropriate temperature, and the fabric 30 is subjected to the contact heating for an appropriate length of time.

Once the set length of time of the contact heating has passed, the lifting and lowering unit 25 is driven to lower the cassette 12 to a position where the contactless heating is to be performed or the standby position in accordance with the chosen conditions. For example, when the chosen conditions indicate that the contactless heating is to be performed next, the temperature of the heater 23 is adjusted to a set temperature in the contactless heating and then the cassette 12 is moved to a contactless heating position where the contact heating is to be performed.

When all the heating that is specified in the chosen conditions is done, the cassette 12 is lowered to the standby position, and the operation of the heating device 20 is terminated.

Figure 10:
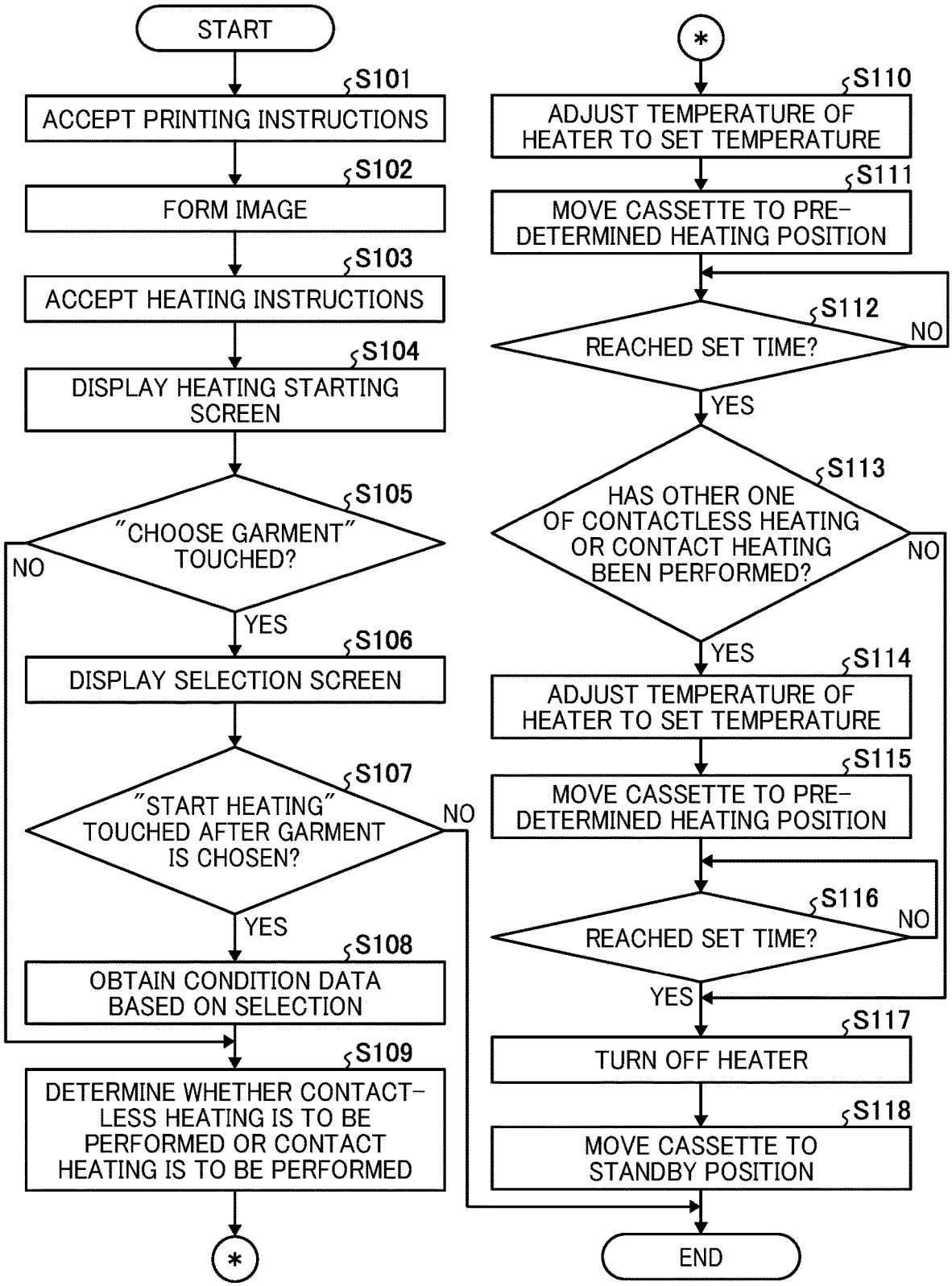
FIG. 10 is a flowchart of the procedure of printing processes performed by a garment printer according to an embodiment of the present disclosure.

FIG. 10 is a flowchart of the procedure of printing processes performed by the garment printer 10 according to the present embodiment.

As illustrated in FIG. 10, as printing instructions and image data are input through the input and output unit 121 of the garment printer 10, in a step S101, the input and output control unit 111 of the garment printer 10 accepts the printing instructions and the image data.

However, no limitation is indicated thereby, and in the above step S101, printing instructions and image data may be input through the input and output unit 421 of the host PC 40, and such input may be accepted by the data transmission and data reception control unit 114 of the garment printer 10.

In a step S102, the image formation control unit 112 according to the present embodiment controls the image forming device 122 to cause ink to be jetted out of the image forming device 122 to form an image on the fabric 30 in accordance with the accepted printing instructions and the image data.

As heating instructions are input through the input and output unit 121 of the garment printer 10, in a step S103, the input and output control unit 111 of the garment printer 10 accepts such heating instructions. Then, in a step S104, the input and output control unit 111 controls the input and output unit 121 to display the heating starting screen 121*a* in accordance with the accepted heating instructions.

When the "start heating" key is touched or clicked on the heating starting screen 121*a* displayed on the input and output unit 121, the input and output control unit 111 accepts touching or clicking of the "start heating" key ("NO" in the step S105). Accordingly, the printer controller 100 of the garment printer 10 proceeds to and performs the processes in the step S109 based on the conditions that are linked to the currently-selected material.

When the "choose garment" key is touched or clicked on the heating starting screen 121*a* displayed on the input and output unit 121, the input and output control unit 111 accepts touching or clicking of the "choose garment" key ("YES" in the step S105). Accordingly, in a step S106, the input and output control unit 111 controls the input and output unit 121 to display the selection screen 121*b*.

When the "cancel" key is touched or clicked on the selection screen 121*b* displayed on the input and output unit 121, the input and output control unit 111 accepts touching or clicking of the "cancel" key ("NO" in the step S107). Accordingly, the printer controller 100 of the garment printer 10 terminates the processes without executing any further heating.

If the "start heating chosen material" key is touched or clicked after the reference number of one of the materials is chosen on the selection screen 121*b* displayed on the input and output unit 121, the input and output control unit 111 accepts touching or clicking of the "start heating chosen material" key and receives the data of the reference number of the chosen material ("YES" in the step S107).

Note also that the above processes in the steps S104 to S107 may be performed by the input and output unit 421 of the host PC 40 under the control of the printer driver of the host PC 40. In such a configuration, when the "start heating chosen material" key is touched or clicked on the input and output unit 421 of the host PC 40, the data transmission and data reception control unit 114 of the garment printer 10 may accept touching or clicking of the "start heating chosen material" key and receive the data of the reference number of the material chosen on the host PC 40.

In a step S108, the catalogue manager 115 according to the present embodiment obtains the conditions that are linked to the received reference number of the chosen material from the garment catalogue 116*a* stored in the storage unit 116, based on the accepted reference number of the material. As the heating control unit 113 reads the obtained conditions, the conditions are loaded into the heating control unit 113.

In a step S109, the heating control unit 113 refers to the conditions chosen in the processes in the step S105 or the step S107, and determines whether the contactless heating is to be performed or the contact heating is to be performed. In a step S110, the heating control unit 113 adjusts the temperature of the heater of the heating unit 123 to a set temperature of the chosen one of the contact heating and the contactless heating such that the determined one of the contactless heating and the contact heating will be performed appropriately. Once the temperature of the heater has been adjusted to the set temperature, in a step S111, the heating control unit 113 controls the lifting and lowering unit of the heating unit 123 to lift the cassette stored in the heating unit from the standby position to a prescribed heating position that is the heating position of the chosen one of the contact heating and the contactless heating.

The heating control unit 113 refers to the chosen conditions, and maintains the heater temperature of the heating unit 123 and the position of the cassette until the time reaches the set length of time of the chosen one of the contact heating and the contactless heating ("NO" in the step S112).

When the time has reached the set length of time of the chosen one of the contact heating and the contactless heating ("YES" in the step S112), in a step S113, the heating control unit 113 refers to the chosen conditions, and determines whether to perform the other one of the contactless heating and the contact heating. When it is determined that the other one of the contactless heating and the contact heating is not to be performed ("NO" in the step S113), the heating control unit 113 terminates the heating by the heating unit 123.

When it is determined that the other one of the contactless heating and the contact heating is to be performed ("YES" in the step S113), in a step S114, the heating control unit 113 adjusts the temperature of the heater of the heating unit 123 to a set temperature of the other one of the contact heating and the contactless heating in accordance with the chosen conditions. Once the temperature of the heater has been adjusted to the set temperature, in a step S115, the heating control unit 113 controls the lifting and lowering unit of the heating unit 123 to move the cassette in the heating unit from the current position to a prescribed heating position that is the heating position of the other one of the contact heating and the contactless heating.

The heating control unit 113 refers to the chosen conditions, and maintains the heater temperature of the heating unit 123 and the position of the cassette until the time reaches the set length of time of the other one of the contact heating and the contactless heating ("NO" in the step S116).

When the time has reached the set length of time of the other one of the contact heating and the contactless heating ("YES" in the step S116), in a step S117, for example, the heating control unit 113 turns off the heater of the heating unit 123. However, no limitation is indicated thereby. Depending on, for example, how frequently the garment printer 10 is used and how the garment printer 10 is operated, for example, instead of turning off the heater, the temperature of the heater may be maintained at a preheating temperature that is lower than the temperature when the heating is being performed.

In a step S118, the heating control unit 113 controls the lifting and lowering unit of the heating unit 123 to lower the cassette to the standby position.

Due to the processes as described above, the printing processes in the garment printer 10 according to the present embodiment are completed.

In the flowchart of FIG. 10, it is assumed that the conditions for the heating are chosen after image-forming processes have been done by the image forming device 122. However, no limitation is indicated thereby, and for example, the conditions for the heating may be chosen when printing instructions are input.

In such a configuration, the heating controller 113 starts increasing the temperature of the heater that is in an off state or preheating state at an earlier stage than the timing of the step S109, for example, immediately after the cassette is accommodated inside the heating unit 123. As a result, the length of time it takes for the temperature of the heater to reach the set temperature in one of the contactless heating and the contact heating determined in the chosen conditions can be shortened.

Control Sample

For a garment printer according to a control sample of the above embodiment of the present disclosure, technologies to perform two-step heating are known in the art. In such known technologies, contact heating is performed after contactless heating is done. Due to such a configuration, the durability of ink fixation improves, and the length of time it takes to complete fixing operation can be shortened. However, in the garment printer according to the present control sample of the above embodiment of the present disclosure, the order in which the contactless heating and the contact heating are performed, the temperature and length of time in contactless heating, and the temperature and length of time in contact heating are fixed and cannot be changed. Due to such a configuration, the setting of the heating may be inappropriate in view of the characteristics or properties of various types of fabric.

In the related art, when the contact heating is to be performed after the contactless heating, various degrees of processing time and heating temperature is determined in advance depending on the type or kind of an object to be heated, and processing time and heating temperature suitable for the object to be heated may be readout when the type of material of the object to be heated is input.

However, in such related art, how the processes implemented by what kind of configuration or structure is not explicitly disclosed. Moreover, in such related art, both the contactless heating and the contact heating are performed without exception. Further, in such related art, the contact heating must be performed after the contactless heating, and the order in which the contact heating and the contactless heating are performed is determined in advance and cannot be changed.

With the garment printer 10 according to the present embodiment, the storage unit 116 stores the garment catalogue 116*a* in which the conditions that are determined for each one of the types or kinds of the fabric are written. Due to this configuration, the conditions suitable for the fabric 30 on which printing is to be performed can be chosen, and appropriate heating control can be done depending on the type or kind of the material. Due to such a configuration, the durability of ink fixation improves, and the length of time of heating operation can be shorted.

With the garment printer 10 according to the present embodiment, whether the contactless heating is to be performed, whether the contact heating is to be performed, the order in which the contactless heating and the contact heating are performed, and the temperature and the length of time in the heating to be performed are determined for each one of the types or kinds of the material in the conditions retained in the garment catalogue 116*a*. Due to this configuration, for example, the combination of the contactless heating and the contact heating and the order in which the contactless heating and the contact heating are performed can be selected for each one of the types or kinds of the fabric, and the degree of flexibility in heating condition can significantly be increased. More specifically, not only the temperature and length of time in the contactless heating and the contact heating can be selected for each one of the types or kinds of the fabric, but also whether both the contactless heating and the contact heating are to be performed or only one of the contactless heating and the contact heating is to be performed can be selected for each one of the types or kinds of the fabric.

With the garment printer 10 according to the present embodiment, desired conditions can be chosen from the garment catalogue 116*a* based on the type of fabric of the fabric 30 on which printing is to be performed. As described above, desired conditions can be chosen based on the type of fabric of the fabric 30. Due to this configuration, the conditions suitable for the fabric 30 on which printing is to be performed can easily be chosen from a plurality of sets of conditions retained in the garment catalogue 116*a*.

Once the garment printer 10 according to the present embodiment receives heating instructions, the type of the currently-chosen fabric is presented to a user, and whether the heating is to be started with the conditions that are linked to the currently-selected fabric or the conditions are to be changed to the conditions that are linked to a different kind of fabric can be selected. Due to this configuration, when the chosen type of fabric matches the fabric 30 on which printing is to be performed, the heating processes can be performed without asking a user or the like to choose the conditions.

When the garment printer 10 according to the present embodiment receives instructions to change the conditions to the conditions that are linked to a different kind of fabric, the list of fabric in which each type of fabric is linked to suitable conditions, which is retained in the garment catalogue 116*a*, is displayed to a user or the like, and desired conditions are chosen based on the type of fabric of the fabric 30 on which printing is to be performed. As described above, with the garment printer 10 according to the present embodiment, consistently, desired conditions can be chosen based on the type of fabric of the fabric 30, and the conditions can be selected more easily.

The usability of the garment printer 10 according to the present embodiment improves when at least one of the above user interfaces (UI) is provided.

With the garment printer 10 according to the present embodiment, in each one of the set of conditions retained in the garment catalogue 116*a*, a parameter that has an impact on at least one of the durability of ink fixation, the efficiency of heating operation, and the prevention of discoloration on the fabric is optimized for each fabric. Due to this configuration, discoloring of ink after the washing due to lack of heating and discoloration or sharing of the fabric 30 due to excessive heating can efficiently be controlled. Moreover, the length of time of heating operation can be shorted, and the efficiency of the heating can be improved.

With the garment printer 10 according to the present embodiment, instructions to choose from the garment catalogue 116*a* a set of conditions for the fabric 30 on which printing is to be performed can be received from the host PC 40, and as described above, a user interface (UI) is provided for the printer driver that is executed by the host PC 40 such that conditions for the heating can be chosen thereon. Due to this configuration, even if a user of the like is apart from the garment printer 10, such a user or the like can perform an operation to choose a set of conditions, and the usability further improves.

OTHER EMBODIMENTS

For example, the program to be executed by the garment printer 10 according to the above embodiment of the present disclosure and the garment catalogue 116*a* retained in the garment printer 10 may be provided upon being stored in a computer-readable recording medium. Such a computer-readable recording medium may be, for example, a magnetic disk, an optical disk, a magneto-optical disk, and a flash memory. Alternatively, the program to be executed by the garment printer 10 and the garment catalogue retained in the garment printer 10 may be downloaded from, for example, a server placed in the network.

In the above embodiment of the present disclosure, it is assumed that the garment printer 10 is controlled by the printer controller 100. However, no limitation is indicated thereby, and each one of the print engine 11 and the heating device 20 may be controlled by a separate controller. In such a configuration, each controller may be configured as a computer that includes, for example, a CPU, a ROM, a RAM, a storage device, and an external interface.

Moreover, in terms of the functional configuration, the controller that controls the heating device includes, at least, a heating control unit, a catalogue manager, and a storage unit that stores a garment catalogue. Further, the controller that controls the heating device may be built into the heating device. In such a configuration, the heating device may be provided with an operation panel to accept instructions on what conditions are to be chosen. Alternatively, the heating device may have a function to receive chosen conditions from the host PC.

In the above embodiments of the present disclosure, it is assumed that the garment printer 10 is configured as a computer including, for example, the CPU 101, the ROM 102, and the RAM 103.

However, no limitation is indicated thereby, and some of or all of the functionality of the garment printer may be implemented by an application-specific integrated circuit (ASIC).

Further, as described above, any one of the above-described and other methods of the present disclosure may be embodied in the form of a computer program stored on any kind of storage medium. Examples of storage media include, but are not limited to, flexible disks, hard disks, optical discs, magneto-optical discs, magnetic tape, nonvolatile memory cards, read only memory (ROM), etc. Alternatively, any one of the above-described and other methods of the present disclosure may be implemented by ASICs, prepared by interconnecting an appropriate network of conventional component circuits, or by a combination thereof with one or more conventional general-purpose microprocessors and/or signal processors programmed accordingly.

What is claimed is:

1. A print processing apparatus comprising:

a heating device including a heater, the heater being configured to perform at least one of contactless heating to heat a fabric in a state where the heater is not in contact with the fabric and contact heating to heat the fabric in a state where the heater is in contact with the fabric;

a memory configured to store a condition table retaining a condition in which whether the contactless heating is to be performed, whether the contact heating is to be performed, an order in which the contactless heating and the contact heating are performed, and a temperature and a length of time in at least one of the contactless heating and the contact heating to be performed are determined for each kind of the fabric;

an input and output unit through which the condition is selected from the condition table based on a kind of the fabric on which printing is to be performed; and a controller configured to control elements of the print processing apparatus, the elements of the print processing apparatus including the heating device, the memory, and the input and output unit, wherein the controller is configured to cause the heating device to perform the at least one of the contactless heating and the contact heating specified in the selected condition on the fabric with the temperature, the length of time, and the order in which the contactless heating and the contact heating are performed, which are specified in the selected condition.

2. The print processing apparatus according to claim 1, wherein the input and output unit is configured to present the kind of the fabric that is currently selected in response to receiving an instruction to perform at least one of the contactless heating and the contact heating, and wherein whether at least one of the contactless heating and the contact heating is to be started with the condition linked to the fabric that is currently selected or the condition is to be changed to a different condition linked to a different kind of fabric is presented by the input and output unit to be selectable through the input and output unit.

3. The print processing apparatus according to claim 2, wherein the condition table retains a list of fabric in which each kind of fabric is linked to a suitable condition, wherein the input and output unit is configured to display the list of fabric when an instruction is made to change the condition to a different condition linked to a different kind of fabric, and wherein the condition is displayed to be selectable through the condition table based on a type of fabric of the fabric on which printing is to be performed.

4. The print processing apparatus according to claim 1, further comprising an image forming device configured to cause an ink to be jetted onto the fabric.

5. The print processing apparatus according to claim 1, wherein the condition includes a parameter that has an impact on at least one of durability of an ink to be jetted onto the fabric, an efficiency of at least one of the contactless heating and the contact heating, and prevention of discoloration on the fabric, and wherein the parameter is optimized for the fabric.

6. The print processing apparatus according to claim 1, wherein the input and output unit is provided for a host computer, the host computer being an external device of the print processing apparatus, and wherein the controller is configured to receive from the host computer, an instruction to choose the condition for the fabric on which printing is to be performed from the condition table.

7. A heating device comprising:

a heater configured to heat a fabric on which an image is formed by jetted ink;

a lift configured to lift or lower the fabric to a contactless heating position where contactless heating is performed to heat the fabric in a state where the heater is not in contact with the fabric and to a contact heating position where contact heating is performed to heat the fabric in a state where the heater is in contact with the fabric;

a memory configured to store a condition table retaining a condition in which whether the contactless heating is to be performed, whether the contact heating is to be performed, an order in which the contactless heating and the contact heating are performed, and a temperature and a length of time in at least one of the contactless heating and the contact heating to be performed are determined for each kind of the fabric; and a controller configured to control elements of the heating device, the elements of the heating device including the heater, the lift, and the memory, wherein the controller is configured to control the heater and the lift to perform, on the fabric with the jetted ink, at least one of the contactless heating and the contact heating specified in the condition selected from the condition table based on a kind of the fabric on which printing is to be performed, with the temperature, the length of time, and the order in which the contactless heating and the contact heating are performed, which are specified in the selected condition.

8. A method of performing a printing process, the method comprising:

selecting a condition based on a kind of fabric on which printing is to be performed from a condition table retaining a set of conditions in which whether to perform contactless heating to heat a fabric on which an image is formed by jetted ink in a state where a heater is not in contact with the fabric, whether to perform contact heating to heat the fabric in a state where the heater is in contact with the fabric, an order in which the contactless heating and the contact heating are performed, and a temperature and a length of time of at least one of the contactless heating and the contact heating to be performed are determined for each kind of the fabric; and performing at least one of the contactless heating and the contact heating specified in the selected condition on the fabric with the jetted ink, with a temperature, a length of time, and an order in which the contactless heating and the contact heating are performed, which are specified in the selected condition.

* * * * *